US005711432A

United States Patent [19]

Stein et al.

[11] Patent Number: 5,711,432

[45] Date of Patent: Jan. 27, 1998

[54] PILFER-RESISTANT PEG HOOK ASSEMBLY

[75] Inventors: Arthur Stein, Whitestone, N.Y.; William C. Updegrave, Jackson, N.J.

[73] Assignee: Display Technologies, Inc., Whitestone, N.Y.

[21] Appl. No.: 616,181

[22] Filed: Mar. 15, 1996

[51] Int. Cl.[6] ..... F16M 13/00

[52] U.S. Cl. ..... 211/57.1; 211/59.1; 248/551; 248/303

[58] Field of Search ..... 211/57.1, 59.1, 211/4, 6; 248/214, 551; 40/655, 657, 659

[56] References Cited

U.S. PATENT DOCUMENTS

| | | | |
|---|---|---|---|
| 1,755,927 | 4/1930 | Levinsohn . | |
| 2,205,298 | 6/1940 | Lindner | 133/11 |
| 3,655,061 | 4/1972 | Pescheke-Koedt | 211/57 |
| 3,785,501 | 1/1974 | Canning | 211/7 |
| 4,013,252 | 3/1977 | Braverman | 248/220.4 |
| 4,104,817 | 8/1978 | Herzog | 40/19.5 |
| 4,289,242 | 9/1981 | Kenyon | 211/59.1 X |
| 4,394,909 | 7/1983 | Valiulis et al. | 211/59.1 |
| 4,405,051 | 9/1983 | Thalenfeld | 40/657 X |
| 4,474,300 | 10/1984 | Entis | 211/57.1 |
| 4,646,454 | 3/1987 | Fast | 40/124.1 |
| 4,783,033 | 11/1988 | Valiulis | 211/59.1 X |
| 4,823,964 | 4/1989 | Lundberg | 211/57.1 |
| 4,850,557 | 7/1989 | Valiulis | 248/220.4 |
| 4,905,846 | 3/1990 | Calvert | 211/59.1 |
| 4,989,815 | 2/1991 | McAuley | 248/225.2 |
| 5,009,334 | 4/1991 | Bodkins | 211/54.1 |
| 5,014,949 | 5/1991 | Niven | 248/220.4 |
| 5,027,622 | 7/1991 | Hatch et al. | 211/59.1 X |
| 5,048,785 | 9/1991 | Shaw et al. | 248/306 |
| 5,082,215 | 1/1992 | Hutchison | 248/220.4 |
| 5,088,606 | 2/1992 | Boas | 211/57.1 |
| 5,259,220 | 11/1993 | Fredrickson | 211/59.1 X |
| 5,275,027 | 1/1994 | Eklof et al. | 211/4 X |
| 5,348,167 | 9/1994 | Jensen | 211/59.1 X |
| 5,375,725 | 12/1994 | Rosenthal | 211/59.1 |
| 5,423,436 | 6/1995 | Morrow | 211/59.1 |
| 5,441,161 | 8/1995 | Merl | 211/57.1 |
| 5,499,722 | 3/1996 | Goldring | 211/57.1 |
| 5,499,723 | 3/1996 | Morrow | 211/59.1 |
| 5,531,417 | 7/1996 | Valiulis et al. | 211/57.1 X |
| 5,542,633 | 8/1996 | Nagel | 211/59.1 X |
| 5,597,150 | 1/1997 | Stein et al. | 248/551 |

*Primary Examiner*—Alvin C. Chin-Shue
*Assistant Examiner*—Long Dinh Phan
*Attorney, Agent, or Firm*—Amster, Rothstein & Ebenstein

[57] ABSTRACT

A pilfer-resistant peg hook assembly for supporting a plurality of articles incorporating defined slots and enabling only one article at a time to be removed therefrom is formed of a peg hook and a flipper. The peg hook has a pair of opposed ends and a body connecting the same. One of the hook ends is configured and dimensioned to maintain the hook body in a substantially horizontal first plane when mounted on an appropriate surface, and the other of the hook ends is a free end. The hook body is configured and dimensioned to be received in the slots of the articles and extends only in the first plane. The flipper is pivotably secured adjacent the free end and is movable between an enabling orientation enabling at least partial passage of an article along the hook body and onto the flipper as the article initially moves towards the free end, and a blocking orientation precluding passage of an article onto the flipper as the article moves towards the free end. The flipper is cammed into the blocking orientation as the article continues to pass over the flipper towards the free end.

12 Claims, 4 Drawing Sheets

FIG. 3
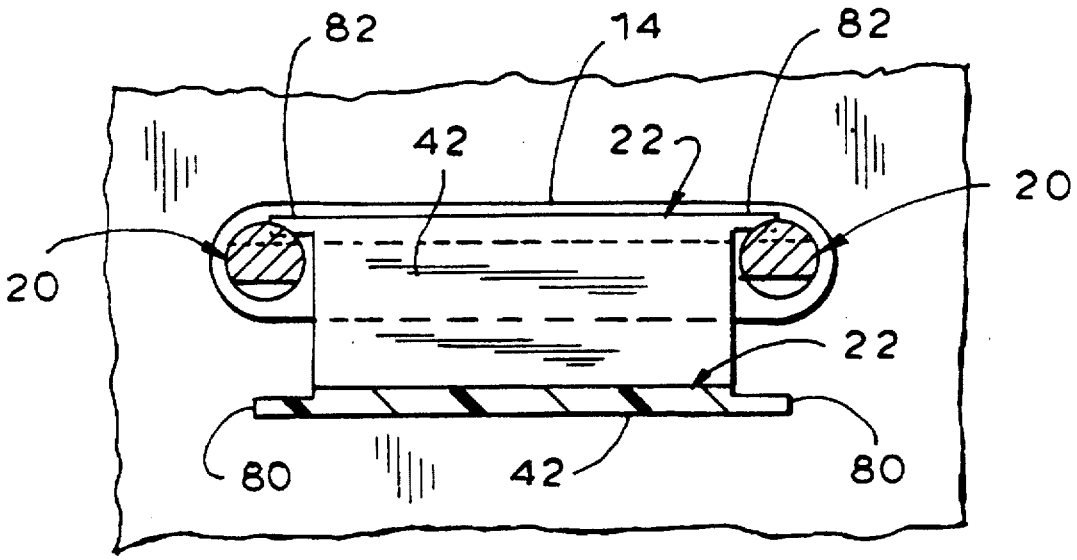
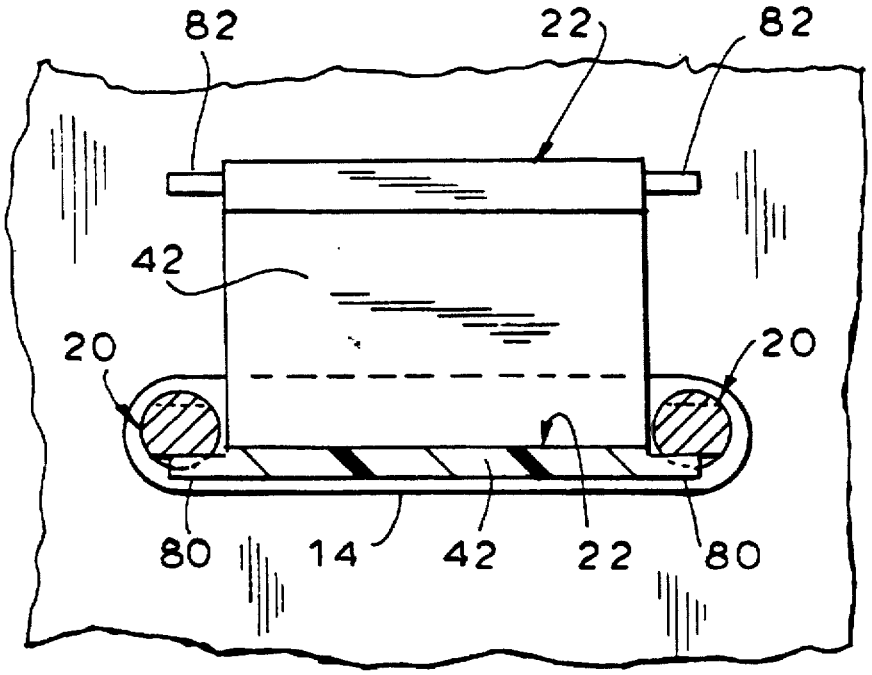
FIG. 5

PILFER-RESISTANT PEG HOOK ASSEMBLY

BACKGROUND OF THE INVENTION

The present invention relates to a peg hook for supporting a plurality of articles incorporating defined slots, and more particularly to a pilfer-resistant peg hook assembly enabling only one article at a time-to be removed therefrom.

Blister packages and other carded articles offered for sale typically incorporate a defined slot which enables the articles to be mounted on a peg hook. The slots may be circular or elongate in the horizontal or vertical directions. The peg hooks serve the function of compactly storing the articles for sale and at the same time providing the prospective purchaser with a clear view of the front thereof. The peg hooks may be mounted at one end to an appropriate peg board, wall or stand (whether rotatable or stationary).

Unfortunately, the conventional peg hook permits the easy removal of not just the forward or leading article, but a plurality or series of the following articles as well. Thus, hit-and-run thieves frequently enter a retail establishment, grab with two hands a whole series of the articles on a peg hook, and, with a single movement, remove the entire series of articles from the peg hook in a fairly rapid operation. The thief may then either simply run away with the loot or rapidly conceal the articles and slowly withdraw from the retail establishment.

Clearly this type of hit-and-run operation can be prevented if the peg hook enables only the forward or leading article of the series to be removed from the peg hook one at a time. Thus, the thief must stand in front of the peg hook, making repeated hand motions in order to obtain a sufficient number of articles to justify the risks involved in the theft. The longer he must stand there removing the articles one-by-one from the peg hook, the greater the likelihood of his being noticed and apprehended.

The problem of pilfering from peg hood mounted displays is well recognized in the prior art as exemplified by U.S. Pat. No. 3,785,501 (a coin-operated system), U.S. Pat. No. 4,474,300 (a key-operated system), U.S. Pat. No. 5,009,334 (using a close-fitting cage about the front of the peg hook) and U.S. Pat. No. 5,014,949 (using an undulating peg hook). Unfortunately, each of these approaches to solving the problem of pilferage has in one way or another defeated the very purposes for which the peg hook display is intended. Thus, the simple, generally horizontal movement of even the forward or leading article is no longer sufficient, and, in the worst cases, extraneous elements such as coins or keys are necessary to enable removal of article from the peg hook. For example, for undulations of the peg hook to be sufficient to impede pilferage the undulations must be so exaggerated that the removal of even the forward or leading article becomes more of an up-and-down motion then a generally horizontal motion on the part of the potential customer. Furthermore, if a series of the articles are loosely held by the thief, several articles can be forced past the undulations (with the several articles moving up and down as necessary to accommodate the undulations), although the number of articles which can thus be removed by a thief in a single swipe is minimized.

Accordingly, it is an object of the present invention to provide a pilfer-resistant peg hook assembly which enables the removal of only one article at a time therefrom.

Another object is to provide such a peg hook assembly which enables a rapid and easy removal of the forward or leading article by a simple, substantially horizontal motion.

A further object is to provide such a peg hook assembly which is easy and convenient for the prospective purchaser to use and does not require the use of extraneous articles such as coins or keys.

It is also an object of the present invention to provide such a peg hook assembly which is simple and economical to manufacture, maintain and use.

SUMMARY OF THE INVENTION

It has now been found that the above and related objects of the present invention are obtained in a pilfer-resistant peg hook assembly for supporting a plurality of articles incorporating defined slots and enabling only one article at a time to be removed. The assembly comprises a peg hook and a flipper. The peg hook has a pair of opposed ends and a body connecting the same. One of the hook ends is configured and dimensioned to maintain the hook body in a first plane when mounted on an appropriate surface and the other of the hook ends is a free end. The hook body is configured and dimensioned to be received in the slots of the articles and extends only in the first plane. The flipper is pivotably secured to the hook adjacent the free end and is movable between an enabling orientation enabling at least partial passage of an article along the hook body and onto the flipper as the article initially moves towards the free end, and a blocking orientation precluding passage of an article onto the flipper as the article moves towards the free end. The flipper is cammed into the blocking orientation as the article continues to pass over the flipper towards the free end. Preferably the flipper is returned by gravity into the enabling orientation by the article passing off the free end of the hook.

In a preferred embodiment, the flipper defines a generally planar front end portion and a generally planar rear end portion, the front and rear end portions being disposed at an obtuse angle, preferably an obtuse angle of 140°–160°, and defining a vertex. The vertex formed by the flipper arms is disposed below the first horizontal plane when the flipper is in the enabling orientation and generally in the first plane when the flipper is in the blocking orientation. The front end portion of the flipper and the free end of the hook are in the same plane when the flipper is in the blocking orientation and in intersecting planes when the flipper is in the enabling orientation. The rear end portion of the flipper and the body of the hook are in generally the same plane when the flipper is in the enabling orientation and in intersecting planes when the flipper is in the blocking orientation. The flipper front end portion is pivotally secured to the free end of the hook, and the flipper rear end portion extends generally towards the one end of the hook. The first plane is substantially horizontal.

Means are provided to limit pivoting of the flipper relative to the hook body in both directions.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 3 is a sectional view taken along the line 3—3 of FIG. 2;

FIG. 5 is a sectional view taken along the line 5—5 of FIG. 4.

DETAILED DESCRIPTION OF THE PREFERRED EMBODIMENTS

Figures 1A, 1B:
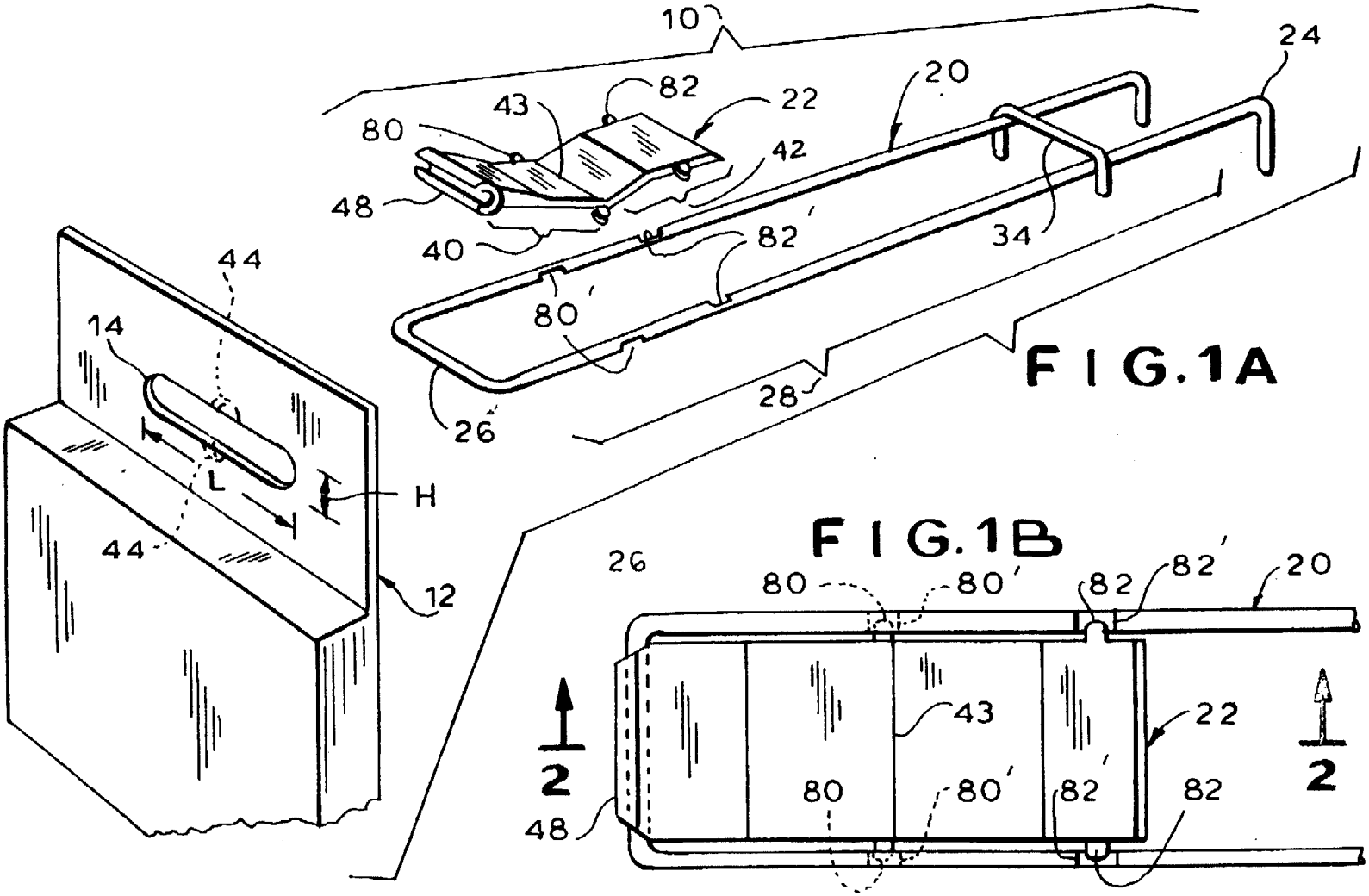
FIG. 1A is an exploded isometric view of the pilfer-resistant peg hook assembly of the present invention and a carded article for use therewith.
FIG. 1B is a top plan view of the assembly in the enabling orientation.

Referring now to the drawing, and in particular to FIG. 1 thereof, there illustrated is a pilfer-resistant peg hook assembly according to the present invention, generally designated by the reference numeral 10. The assembly 10 is designed for supporting a plurality of conventional articles, generally designated 12, such as blister packs and other carded articles. A wide variety of small products are frequently sold in such packages, including batteries, eyeglasses, toiletries, etc. The card portion of the article incorporates a well defined slot 14 formed therethrough, for example, by a die cut. The slot 14 has a length L and a height H, the length L being greater than the height H.

The assembly 10 comprises essentially a peg hook, generally designated 20, and a flipper, generally designated 22. The peg hook 20 has a pair of opposed longitudinal ends 24, 26 and a body 28 connecting the same. The hook body 28 is configured and dimensioned to be received in the article slot 14, and is generally planar and flat. The hook end 24 is configured and dimensioned to maintain the hook body 28 projecting forwardly in a substantially horizontal plane when the hook end 24 is mounted on an appropriate surface such as a peg board (not shown). A wide variety of such hook ends 24 are well known in the peg hook art, and, for the purposes of illustration only, a simple upwardly extending flange at the rear end of the body 28 is shown. The other hook end 26 is a free end which typically also extends in the horizontal plane of the body 28, although a variety of different free ends well known in the peg hook art may be employed instead.

The peg hook 20 is illustrated as being a U-shaped configuration, with the base and two legs thereof fitting snugly within the configuration and dimensions of the article slot 14. This is a preferred design as it precludes rotation of the article 12 about the peg hook 20 and provides a convenient mechanism for securing the flipper 22 thereto. However it will be appreciated that for particular applications a looser fitting peg hook 20 or even a single leg peg hook may be employed. To assist the peg hook 22 in maintaining a "U" configuration, a rear bracing number 34 is secured across the two legs adjacent hook end 24.

The flipper 22 has a generally planar front arm 40 and a generally planar rear arm 42. The front and rear arms 40, 42 are disposed at, and define the vertex 43 of, an upwardly opening obtuse angle, preferably an obtuse angle of 140°–16° and optimally 151°. The front and rear arms 40, 42 are preferably configured and dimensioned to be received within the article slot 14. Thus, where the article slot 14 includes a small central groove 44 of the top thereof, the flipper 22 may also include a raised central rib (not shown) extending along the top surface thereof. The flipper rib cooperates with the card slot groove 44 in centering the article 12 for movement along the flipper 22, especially if the sides of the peg hook body 28 are not in contact with the ends of the article slot 14.

Figure 2:
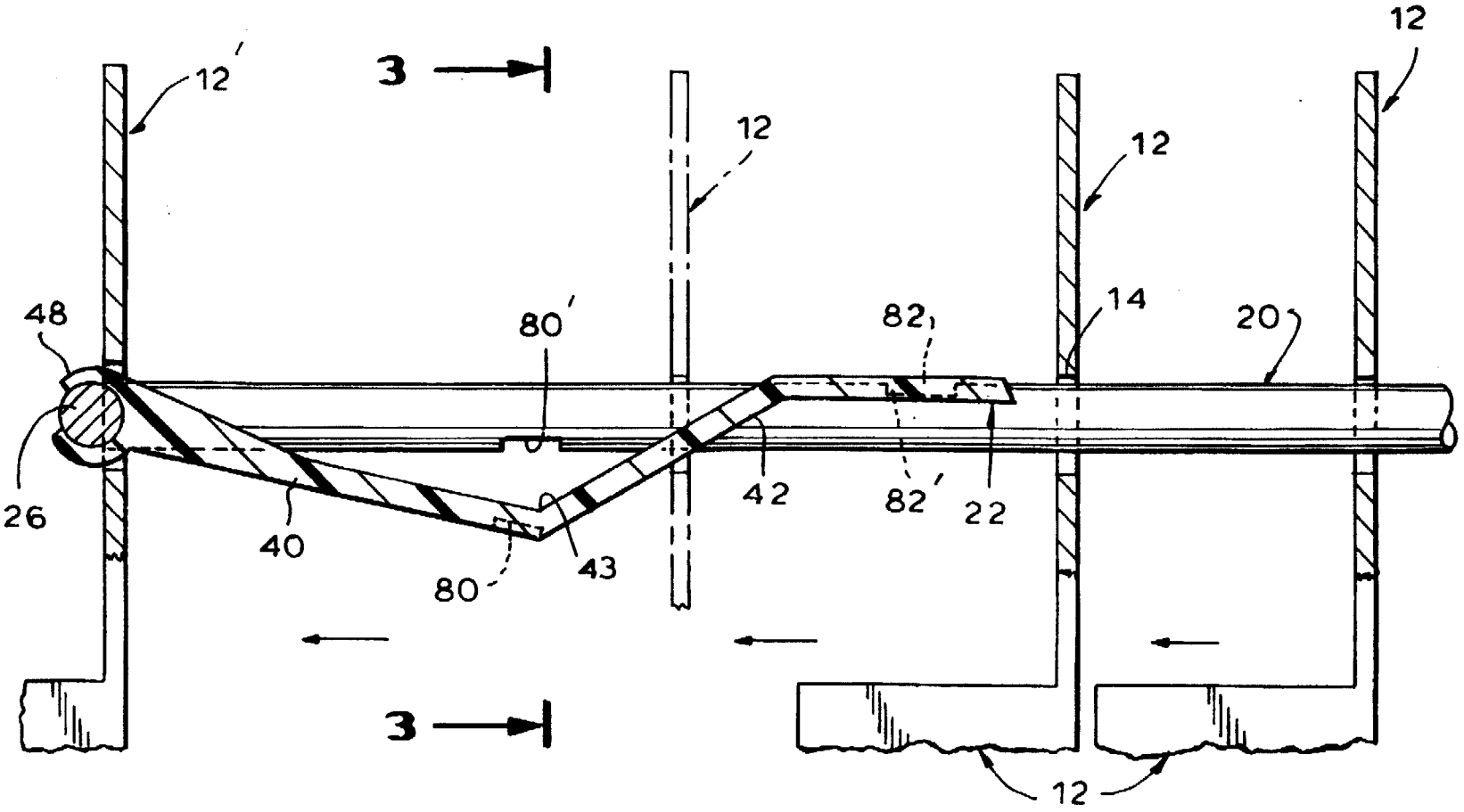
FIG. 2 is a sectional view, taken along the line 2—2 of FIG. 1B with the flipper in the enabling orientation.
Figure 4:
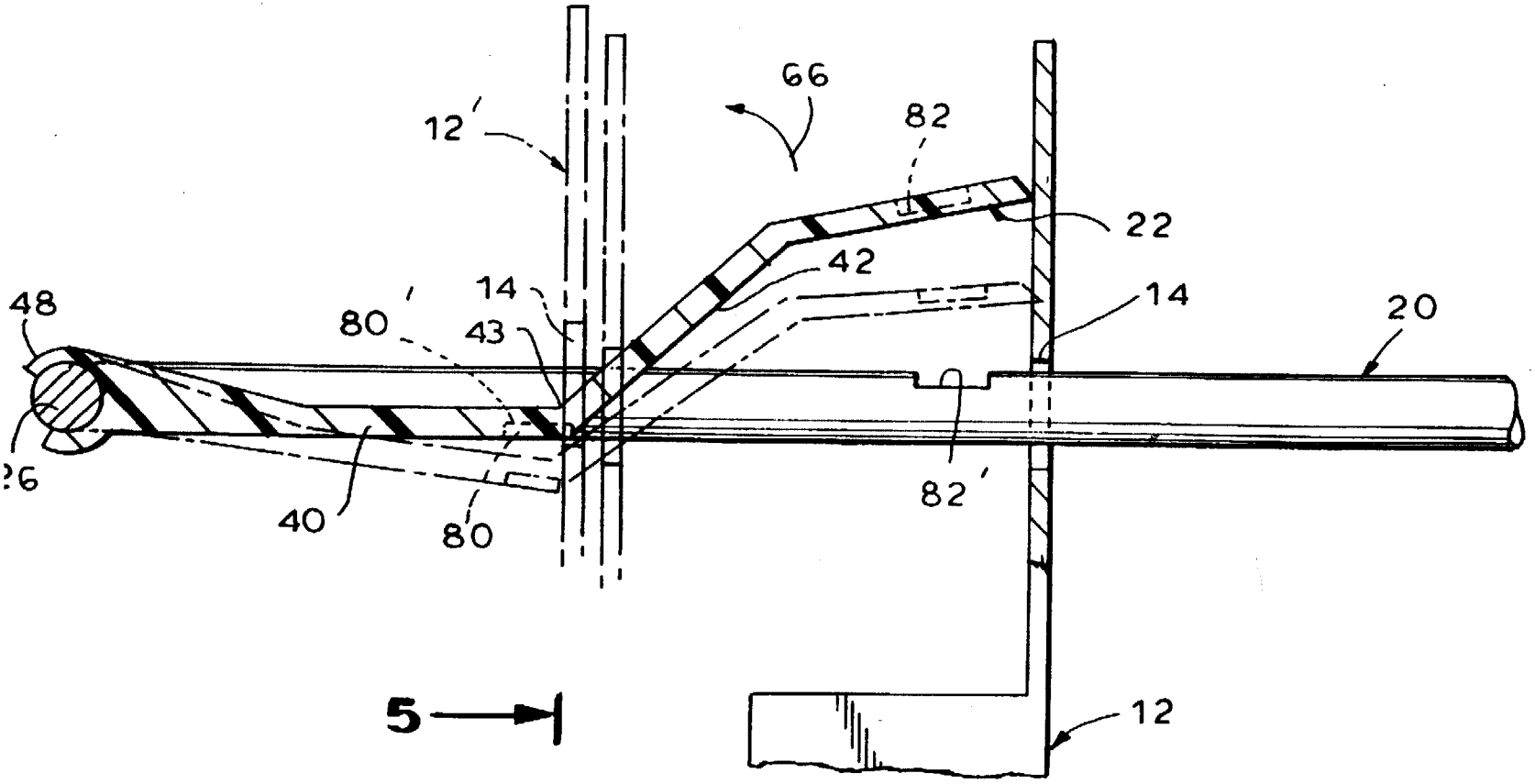
FIG. 4 is a sectional view of the assembly with the flipper in the blocking orientation.

The front and rear flipper arms 40, 42 are preferably of equal width and generally capable of passing between the legs of the peg hook 20 except for the stops to be described hereinafter. The front end of flipper 22 is configured and dimensioned to pivotably wrap around the base of the U-shaped peg hook 20—i.e., the front thereof. The ends of the base of the "U", which constitute the forward or leading end of the peg hook 20, permit the flipper 22 to be pivoted between an enabling orientation enabling at least partial passage of an article 12 along the hook body 28 and onto the flipper rear arm 42 as the article moves towards the body free end 26 (as illustrated in FIG. 2), and a blocking orientation precluding passage of an article 12 onto the flipper rear arm 42 as the article 12 moves toward the hook free end 26 (as illustrated in FIG. 4). Thus the free end 26 of the hook 20 and the front arm 40 of the flipper 22 are in intersecting planes when the flipper 22 is in the enabling orientation illustrated in FIG. 2 and in the same or common plane when the flipper 22 is in the blocking orientation illustrated in FIG. 4. The rear arm 42 of the flipper 22 and the body 28 of the hook 20 are in the same plane when the flipper 22 is in the enabling orientation illustrated in FIG. 2 and in intersecting planes when the flipper 22 is in the blocking orientation illustrated in FIG. 4.

The flipper 22 is illustrated with its vertex 43 extending below the horizontal plane of the hook 22 in FIG. 2 (when the flipper 22 is in the enabling orientation) and generally in the horizontal plane of the hook in FIG. 4 (when the flipper is in the blocking orientation).

As best seen in FIG. 4, the flipper 22 is cammed in the direction of arrow 66 into the blocking orientation by the slot 14 of the forward or leading article 12' passing over the flipper front arm 40. The raised rear end of the flipper rear arm 42 then blocks all but the lead article 12' from being removed until the lead article 12' has passed beyond the free end of the hook 20. As best seen in FIG. 2, once the lead article 12' is past the hook free end 26 (i.e., off both the hook 20 and flipper 22), the flipper 22 returns (in the direction of arrow 68) under the influence of gravity into the enabling orientation, thereby allowing the next article 12 to be moved along the hook body 28 and onto the rear arm 42 of flipper 22. Care must be taken to keep the flipper 22 and at least the front of the peg hook 20 clean as otherwise the debris, sticky material and the like typically found in a store may impair the easy pivotability of flipper 22 and fix the flipper 22 in the blocking orientation against the relatively weak force of gravity.

While the dimensions of the peg hook 20 will vary with the intended applications thereof, typically in one preferred embodiment it is made of about 0.175 inch wire (optionally coated with plastic) formed in a "U" configuration with the legs horizontally spaced apart about 0.925 inch. The central portion of the base of the "U" is preferably cylindrical to enable pivotal movement of the flipper 22 on the lateral portions of the base while preventing it from twisting completely thereabout. The longitudinal (i.e., horizontal) extension of the body 28 is about 4–10 inches. The vertical spacing of the vertex from the flipper arm ends is about 0.277 inch. The hook free end 26 terminates in a resiliently openable, U-shaped mouth for pivotal attachment to the base of the "U" of the hook. While the configuration and dimensions of the flipper 22 will vary with those of the peg hook 20, the front arm 40 of the flipper 22 is preferably about 1 inch by 0.5 inch, and the rear arm 42 is about 1 inch by 0.5 inch. The flipper 22 is conveniently injection molded and, more particularly, insertion injection molded.

Means are provided to limit pivoting of the flipper 22 relative to the hook body 28 in both directions. Thus the flipper 22 is provided with a first stop means 80 designed to engage the lower surface of the peg hook 20 to limit by abutment clockwise rotation of the flipper 22 relative to the peg hook 20 and a second stop means 82 designed to engage the uppersurface of the peg hook 20 to limit by abutment counterclockwise rotation of the flipper 22 relative to the peg hook 20. The stop first and second means 80, 82 are illustrated as lugs projecting outwardly from the flipper 22 on both sides thereof a distance sufficient to engage respective legs of the peg hook 20. The first stop means 80 is aligned generally with the vertex 43 formed by the front and rear flipper arms 40, 42, and the second stop means 82 is disposed adjacent the rear end of the rear flipper arm 42. The legs of the peg hook 20 may be flattened at the points of abutment with stop means 80, 82 to increase the area of abutment and thus reduce wear. As will be apparent to those skilled in the art, the first and second stop means 80, 82 may alternatively be located in other positions and, indeed, replaced by stop means in the form of inwardly extending projections on the legs of the hook 20 configured and dimensioned to limit by abutment rotation of flipper 22.

The rear end of the rear flipper arm 42 is preferably beveled and smoothed in order to facilitate the movement of the articles along the hook body 28 and onto the rear flipper arm 42.

Because the peg hook assembly of the present invention enables only one article at a time to be removed therefrom, it slows down the removal from a peg hook of any sizable plurality of articles to the point where detection or apprehension of the thief becomes more likely.

While the assembly of the present invention has been described in the terms of a peg hook which is mounted in a substantially horizontal plane for use with an article having a defined horizontally-extending slot, alternatively the peg hook may be mounted in a substantially vertical plane for use with an article having a defined vertically-extending slot. In other words, the assembly could be rotated 90° clockwise or counterclockwise for use with an article having a vertical slot rather than a horizontal slot. However, as the force of gravity is not available to bias the flipper to the enabling orientation in this rotated embodiment, it would be necessary to deploy a spring or like biasing means to this end.

To summarize, the present invention provides a pilfer-resistant peg hook assembly which enables the removal of only one article at a time therefrom while at the same time enabling a rapid and easy removal of the forward or leading article by a simple, substantially horizontal motion. The assembly is easy and convenient for the prospective purchaser to use, and does not require the use of extraneous articles such as coins or keys. The assembly is simple and economical to manufacture, maintain and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not the foregoing specification.

We claim:

1. A pilfer-resistant peg hook assembly for supporting a plurality of articles incorporating defined camming slots and enabling only one article at a time to be removed, comprising:

(A) a peg hook having a pair of opposed ends and a body connecting the same, one of said hook ends being configured and dimensioned to maintain said hook body in a first plane when mounted on an appropriate surface and the other of said hook ends being a free end, said hook body being configured and dimensioned to be received in the slots of the articles and extending only in said first plane; and (B) a flipper pivotably secured to said hook adjacent said free end and being movable between an enabling orientation enabling at least partial passage of an article along said hook body and onto said flipper as the article initially moves towards said free end, and a blocking orientation precluding passage of another article onto said flipper by the camming slot as the article moves towards said free, end, said flipper including a cammed slot being cammed into said blocking orientation as the article continues to pass over said flipper towards said free end.

2. The peg hook assembly of claim 1 wherein said flipper defines a generally planar front end portion and a generally planar rear end portion, said front and rear end portions being disposed at an obtuse angle and defining a vertex.

3. The peg hook assembly of claim 2 wherein said front and rear end portions of said flipper define an obtuse angle of 140°–160°.

4. The peg hook assembly of claim 2 wherein said front end portion of said flipper and said free end of said hook are in the same plane when said flipper is in said blocking orientation and in intersecting planes when said flipper is in said enabling orientation.

5. The peg hook assembly of claim 4 wherein said rear end portion of said flipper and said body of said hook are in generally the same plane when said flipper is in said enabling orientation and in intersecting planes when said flipper is in said blocking orientation.

6. The peg hook assembly of claim 2 wherein said rear end portion of said flipper and said body of said hook are in generally the same plane when said flipper is in said enabling orientation and in intersecting planes when said flipper is in said blocking orientation.

7. The peg hook assembly of claim 1 wherein said flipper is returned by gravity into said enabling orientation by an article passing off said free end of said hook.

8. The peg hook assembly of claim 1 wherein said flipper front end portion is pivotally secured to said free end of said hook and said flipper rear end portion extends generally towards said one end of said hook.

9. The peg hook assembly of claim 1, wherein said first plane is substantially horizontal.

10. The peg hook assembly of claim 2 wherein said vertex is disposed below said first plane when said flipper is in said enabling orientation, and generally in said first plane when said flipper is in said blocking orientation.

11. The peg hook assembly of claim 1 including means to limit pivoting of said flipper relative to said hook body in both directions.

12. A pilfer-resistant peg hook assembly for supporting a plurality of articles incorporating defined camming slots and enabling only one article at a time to be removed therefrom, comprising:

(A) a generally horizontal peg hook having a pair of opposed ends and a body connecting the same, one of said hook ends being configured and dimensioned to maintain said body substantially horizontal when mounted on an appropriate surface and the other of said hook ends being a free end, said hook body being configured and dimensioned to be received in the slots of the articles and extending only in said first plane; and (B) a flipper pivotably secured adjacent said free end and extending partially towards said one end, said flipper defining a generally planar front end portion and a generally planar rear end portion, said front and rear end portions being disposed at an obtuse angle of 140°–160°, said flipper being movable between an enabling orientation enabling at least partial passage of an article along said hook body and onto said flipper rear end portion as the article moves towards said free end, and a blocking orientation precluding passage of another article onto said flipper as the article moves towards said free end, said flipper being cammed into said blocking orientation by the camming slots as the article passing over said flipper front end portion and being returned by gravity into said enabling orientation by the article passing off said free end of said hook, said flipper front end portion being pivotally secured to said free end and said flipper rear end portion extending generally towards said one end of said hook;

said front end portion of said flipper and said free end of said hook being in the same plane when said flipper is in said blocking orientation and in intersecting planes when said flipper is in said enabling orientation, and said rear end portion of said flipper and said body of said hook being in the same plane when said flipper is in said enabling orientation and in intersecting planes when said flipper is in said blocking orientation.

* * * * *